US010059475B2

(12) United States Patent
Weagant et al.

(10) Patent No.: US 10,059,475 B2
(45) Date of Patent: Aug. 28, 2018

(54) FILL-ACCURACY DURING POUCH FORMATION

(75) Inventors: Simon Weagant, Courtice (CA); Jason G. Peterson, Lewis Center, OH (US); James W. Sadler, Toronto (CA)

(73) Assignee: Liqui-Box Corporation, Richmond, VA (US)

( * ) Notice: Subject to any disclaimer, the term of this patent is extended or adjusted under 35 U.S.C. 154(b) by 1146 days.

(21) Appl. No.: 12/765,438

(22) Filed: Apr. 22, 2010

(65) Prior Publication Data

US 2010/0275555 A1 Nov. 4, 2010

Related U.S. Application Data

(60) Provisional application No. 61/174,736, filed on May 1, 2009.

(51) Int. Cl.
*B65B 9/213* (2012.01)
*B65B 37/02* (2006.01)
(Continued)

(52) U.S. Cl.
CPC ..... *B65B 9/213* (2013.01); *B65B 3/36* (2013.01); *B65B 37/02* (2013.01); *B65B 37/16* (2013.01);
(Continued)

(58) Field of Classification Search
CPC .... B65B 3/16; B65B 3/26; B65B 3/34; B65B 3/36; B65B 9/10; B65B 9/12; B65B 9/13; B65B 9/14; B65B 9/20; B65B 37/16; B65B 3/30; B65B 37/02; B65B 9/213; B65B 3/06; B65B 3/045; B65B 3/04; B65B 9/00–9/24; Y10T 137/86348; Y10T 137/86381
(Continued)

(56) References Cited

U.S. PATENT DOCUMENTS 1,173,365 A * 2/1916 McComb ..... 422/282
1,749,161 A * 3/1930 Schnaier ..... 222/429
(Continued)

FOREIGN PATENT DOCUMENTS

DE 1037947 B * 8/1958 ..... B65B 3/30
EP 0196285 A2 10/1986
(Continued)

OTHER PUBLICATIONS

JPO machine translation of JP 11-348911, retrieved from http://www4.ipdl.inpit.go.jp/Tokujitu/tjsogodbenk.ipdl, Jan. 19, 2012, 7 pages.*
(Continued)

*Primary Examiner* — Stephen F Gerrity
(74) *Attorney, Agent, or Firm* — Baker & Hostetler LLP

(57) ABSTRACT

In one of its aspects, the present invention relates to a process for forming a flexible liquid-packaging pouch. This process improves fill-accuracy of the flowable material contained in the pouch. Specifically, the invention relates to a process for improving the fill-accuracy of a pouch by incorporating at least one stand-pipe in a balance tank that feeds the pouch with flowable material to be packaged. This invention also relates to such apparatus for improving the fill-accuracy of the flexible liquid-packaging pouch.

9 Claims, 3 Drawing Sheets

(51) Int. Cl.
*B65B 37/16* (2006.01)
*B65B 3/36* (2006.01)

(52) U.S. Cl.
CPC ... *B65B 2220/18* (2013.01); *Y10T 137/86348* (2015.04); *Y10T 137/86381* (2015.04)

(58) Field of Classification Search
USPC ..... 53/451, 551; 137/207, 593, 590
IPC ..... B65B 3/16,3/26, 3/34, 3/36, 9/10, B65B 9/12, 9/13, 9/14, 9/20, 37/16
See application file for complete search history.

(56) References Cited

U.S. PATENT DOCUMENTS 2,013,678 A * 9/1935 Winton ..... 141/245
2,030,084 A * 2/1936 Winton ..... 141/242
2,186,358 A * 1/1940 Boulich ..... 222/363
2,428,911 A * 10/1947 Gunnell ..... 53/140
2,934,087 A * 4/1960 Crow ..... B60K 15/06 137/590
2,944,573 A * 7/1960 Weideman et al. ..... 141/87
3,320,719 A * 5/1967 Murray ..... 53/551
3,553,740 A * 1/1971 Fogg ..... 137/428
3,628,698 A * 12/1971 Allen et al. ..... 222/168
3,874,402 A * 4/1975 Hazen ..... 137/590
3,886,714 A * 6/1975 de la Poype ..... 53/551
3,922,835 A * 12/1975 Reil ..... 53/551
3,939,005 A * 2/1976 White ..... 127/63
4,246,927 A * 1/1981 Eberle ..... 137/590
4,283,901 A * 8/1981 Schieser et al. ..... 53/284.7
4,531,510 A * 7/1985 Barthez et al. ..... 126/591
4,552,190 A * 11/1985 Wilson et al. ..... 141/82
4,750,534 A * 6/1988 Hirasawa et al. ..... 53/551
4,840,196 A * 6/1989 Antunez ..... 137/410
4,890,644 A * 1/1990 Hoeptner, III et al. ..... 137/590
5,156,193 A * 10/1992 Baruffato et al. ..... 141/1
5,176,174 A * 1/1993 Toraason et al. ..... 137/590
5,195,190 A 3/1993 Nguyen-Hun
5,203,367 A * 4/1993 Akai et al. ..... 137/101.25
6,074,562 A 6/2000 Falkner
6,142,169 A * 11/2000 Lees et al. ..... 137/240
6,182,426 B1 * 2/2001 Pritchard ..... 53/551
6,595,245 B1 * 7/2003 Stagni ..... 141/1
7,076,935 B2 * 7/2006 Basque ..... 53/551
7,299,824 B2 * 11/2007 Golan et al. ..... 137/590
2001/0047641 A1 * 12/2001 Kume et al. ..... 53/551
2003/0056838 A1 * 3/2003 Grayson ..... B64G 1/402 137/590

FOREIGN PATENT DOCUMENTS

GB 711882 A * 7/1954 ..... B65B 3/26
GB 819448 A1 * 9/1959 ..... B65B 3/30
GB 949096 A1 * 2/1964 ..... G01F 11/28
JP 04227044 A * 8/1992 ..... B65B 37/16
JP 11348911 A * 12/1999 ..... B65B 9/20
WO WO2007/140603 A1 12/2007

OTHER PUBLICATIONS

The International Search Report and Written Opinion of the International Searching Authority, Application No. PCT/US2010/033158, dated Sep. 24, 2010. 16 pages.

* cited by examiner

FILL-ACCURACY DURING POUCH FORMATION

CROSS-REFERENCE TO RELATED APPLICATION

This application claims the benefit of U.S. Provisional Application No. 61/174,736 filed May 1, 2009, which is incorporated by reference herein in its entirety.

FIELD OF INVENTION

In one aspect, the present invention relates to a process for forming a flexible liquid-packaging pouch that improves fill-accuracy of the flowable material contained in the pouch. Specifically, the invention relates to a process that incorporates at least one stand-pipe in a balance tank that feeds the pouch with flowable material to be packaged. This invention also relates to such apparatus for improving the fill-accuracy of the flexible liquid-packaging pouch.

BACKGROUND

Flexible liquid-packaging such as pouches are used to package many consumer goods, particularly food and beverages. The term "liquid-packaging" is understood by those skilled in the art to refer to both liquids and other flowable materials or product.

Generally, it is important to obtain optimal fill-accuracy of the flowable material in flexible liquid-packaging pouches. By "optimal" or "optimized" is meant that the variation in fill-accuracy of the product amount in the pouch is generally minimized without sacrificing other critical factors acceptable for packaging use.

This invention relates to improving fill-accuracy, that is, reducing over-fill and under-fill of the pouch. Improving fill-accuracy is important for several reasons, for example, reduction in packaging cost and for complying with government regulations. For example, many states require that an advertised product quantity must be the minimum product quantity contained in a package. Thus, if the fill-accuracy is poor, a vendor must fill the pouch with product amount more than what is advertised, which raises the business cost. Controlling fill-accuracy can therefore help minimize product waste for the vendor.

Several methods are known to those skilled person for delivering product to a package. For example, a flow of material can be established for a period of time filling an open container. In the alternative, a flowmeter can be used to measure the product flow into a container. In the present embodiment, a constant product head is established in a balance tank above the outlet of the balance tank. This configuration provides a constant flow of product into pouches produced on a vertical form fill seal ("VFFS") machine. Once the product fills the first pouch, by a pinching mechanism, the first pouch is separated with the subsequent pouch being filed with the product. The timing of this mechanism and the product flow dictate the product volume in each pouch. Fill-accuracy is predicated on the repeatability of the timing of the pinching mechanism, and on the consistency of the flow.

It is an object of the present invention to improve the consistency of the flow from the balance tank to the pouch. Specifically, the present invention provides a process, apparatus, and a pouch with improved fill-accuracy over the conventional process.

SUMMARY OF INVENTION

This invention relates to a process for forming a pouch with improved fill-accuracy, said process comprising the steps of:

(A) providing a continuous tube of flexible and sealable film;

(B) supplying the continuous tube with a predetermined flow-rate of flowable material fed from an external balance tank; wherein said balance tank comprises an inlet for said flowable material, at least one outlet for said flowable material, and at least one stand-pipe within said balance tank and over said at least one outlet, wherein said stand-pipe is flowably attached to said at least one outlet.

This invention further relates to a pouch formed with improved fill-accuracy according to a process comprising the steps of:

(A) providing a continuous tube of flexible and sealable film;

(B) supplying the continuous tube with a predetermined flow-rate of flowable material fed from an external balance tank; wherein said balance tank comprises an inlet for said flowable material, at least one outlet for said flowable material, and at least one stand-pipe within said balance tank and over said at least one outlet, wherein said stand-pipe is flowably attached to said at least one outlet.

This invention further relates to a package for liquid packaging comprising a pouch as described above, which is inside a secondary container. In one embodiment of the invention, said secondary container is a cardboard box.

This invention also relates to a balance tank for providing flowable material to a fill-seal machine, comprising an inlet for said flowable material, at least one outlet for said flowable material, and at least one stand-pipe over said at least one outlet, wherein said stand-pipe is flowably attached to said at least one outlet.

Finally, this invention also relates to a balance tank described as above, wherein said balance tank comprises at least one drain-hole on the stand-pipe and/or on the floor of the tank.

BRIEF DESCRIPTION OF THE DRAWINGS

Embodiments of the present invention will be described with reference to the accompanying drawings, wherein like reference numerals denote like parts, and in which.

DETAILED DESCRIPTION OF THE INVENTION

Figure 1:
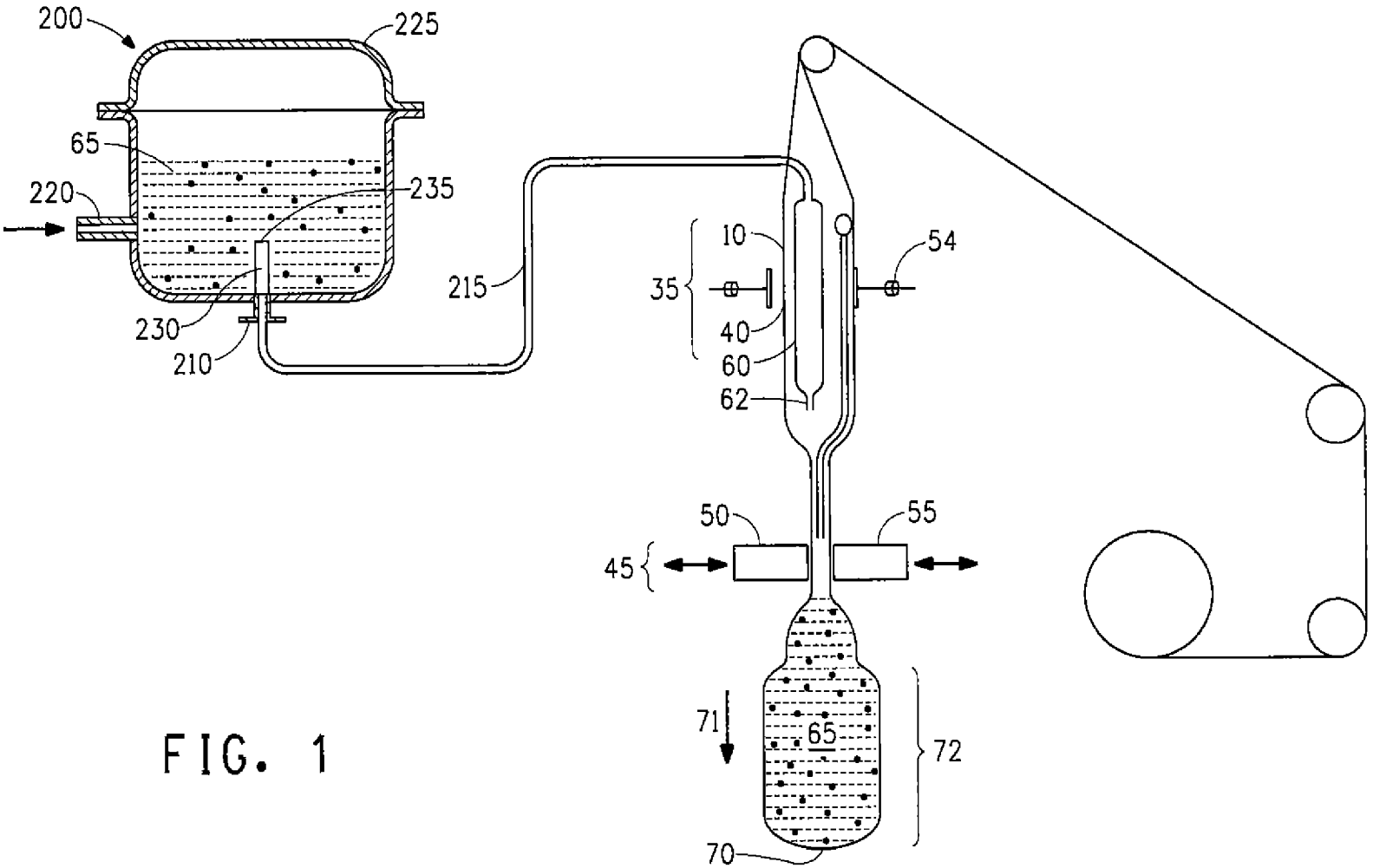
FIG. 1 illustrates a schematic view of an apparatus of the present invention including a vertical form-fill-seal ("VFFS") machine and an external balance tank.

The present invention relates to improving the fill-accuracy of sealed pouches for flexible liquid-packaging made from a continuous film tube. Typically, the process steps for improving such fill-accuracy include filling the continuous film tube with flowable material or product, wherein said flowable material is fed from an external balance tank, and wherein said balance tank comprises at least one stand-pipe over the outlet of the balance tank.

In the description below, flowable material and product are used interchangeably.

Typically, all process steps are performed on a vertical form-fill-seal ("VFFS") type machine. Generally the pouch of the present invention should be sealable and have suitable properties (such as strength and flexibility.) for carrying the desired product. The continuous film tube is made from flexible films well-known to a skilled person. Flexible films include any suitable plastic film material, such as linear low-density polyethylene. A further description of examples of different types of films that can be used with the process of the present invention is provided in a recently filed patent application (patent application Ser. No. 61/155,287).

While pouch volume in the present invention is not particularly restricted, preferred pouch volume ranges from about 1 L to about 12 L, and more preferably, from about 3 L to about 5 L. The product volume in the pouch will depend on the pouch volume.

The fill-accuracy is measured as mass of the product per pouch.

In a conventional pouch-formation process, during operation, product continuously enters the external balance tank through an inlet. The product flows out from the external balance tank through the tank's outlet port. From the outlet port, the product flows into a tubing, which conveys the product to the supply conduit. The supply conduit, in turn, conveys the product to the continuous film tube with the filling starting at the bottom of the continuous film tube. When the volume of product for one pouch has been delivered, a pinching mechanism collapses the film tube transversely, approximately one pouch length above the bottom of the continuous film tube. Generally, the pinching mechanism is a sealing jaw, which seals and cuts the continuous film tube, thereby forming a closed pouch. Concurrently, the product fills the continuous film tube above the pinching mechanism. After the pinching mechanism opens, the closed pouch falls to a conveyor and the continuous film tube is indexed down one pouch-length, and, the process repeats.

In the embodiments of the present invention, while the above steps are the same, the balance tank comprises at least one stand-pipe over the outlet of the balance tank on the tank's inside. The balance tank of the present invention can be of various shapes and sizes. The balance tank level is controlled by a level-controlling mechanism, as will be apparent to a person skilled in the alt.

Generally, a steady-state is maintained in the balance tank during the process, that is, the flow-rate of the product exiting the balance tank is generally the same as the flow-rate of the product entering the balance tank through an inlet port.

Because the product exits at the bottom of the balance tank, localized disturbances generate fluctuations when the product flows into the pouch. These fluctuations, if not minimized between every pouch, will result in product volume variations from one pouch to the next one impacting the fill-accuracy. While this invention is not beholden to a specific fluid-mechanics phenomenon, it is possible that the localized disturbances such as wall effect, localized eddies, and vortices near the entrance of the outlet on the inside of the balance tank adversely impact downstream fill-accuracy of the pouches. The product moving downstream from the outlet may retain the history of these disturbances, which translates into fluctuations in flow.

The present invention improves upon the fill-accuracy of the conventional process described above, by incorporating a stand-pipe inside the balance tank, and in one embodiment, above the outlet port of the balance tank. The stand-pipe, while on the inside of the balance tank, is above the outlet port, but is physically and flowably connected to the outlet port. As a result, the product is withdrawn from the balance tank not exactly from the lowest point in the tank, but from a higher point. At this higher point, the localized disturbances, such as eddies, vortices, and wall-effects are reduced compared to the floor of the balance tank.

In one embodiment, this invention includes a balance tank comprising more than one stand-pipe. FIG. 2 shows various stand-pipe configurations of the present invention. In another embodiment, the present invention includes a balance tank comprising one stand-pipe and multiple outlets.

In another embodiment, said at least one stand-pipe may have cross-section with at least three defined angles, wherein the sides of said cross-section may or may not be equilateral. Exemplary cross-sections include the circular, the square, the rectangular, the pentagonal, the hexagonal, and the heptagonal. In one embodiment, the cross-section is random-shaped. Moreover, the cross-section can vary along the vertical length of said at least one stand-pipe.

In one embodiment, the height of the stand-pipe from the floor of the tank is from about 1% to about 99% of the level of the flowable material in the tank. In a preferred embodiment, the stand-pipe height is in the range of from about 3% to about 25% of the level of the flowable material. In other embodiments, the stand-pipe height is 1%, 2%, 3%, 4%, . . . , 97%, 98%, or 99% of the level of the flowable material in the balance tank. In other embodiments, the height of the stand-pipe can be within any two numbers cited herein above, for example, 1.5%, 2.5%, 3.75%, etc.

In another embodiment, the balance tank comprises more than one stand-pipe. In yet another embodiment, said balance tank further comprises at least two stand-pipes that have different heights measured from the floor of the balance tank. In yet another embodiment, said at least two stand-pipes are of same height.

In one embodiment, the balance tank comprising at least one stand-pipe, as described supra, wherein said at least one stand-pipe further comprises at least one drain-hole at the base of the stand-pipe wall where the standpipe and balance tank intersect for draining residual flowable material from the balance tank. In another embodiment, said drain-hole is located on the floor of the balance tank, but not directly attached to the stand-pipe. In another embodiment, the drain hole is located partially on the stand-pipe wall and partially on the floor of the balance tank, that is the drain hole is a combination of the stand-pipe wall and the floor of the balance tank. In one embodiment, the stand-pipe, while located over the outlet, is not exactly centrally-located on the outlet. In another embodiment, the stand-pipe is substantially centrally-located on the outlet.

In another embodiment, the balance tank comprises more than one outlet, with each outlet having at least one stand-pipe over said outlet.

In one embodiment, the balance tank is filled at least 30% of its total volume capacity. In a preferred embodiment, the balance tank is filled in the range of from about 50% to about 99% of its total volume capacity.

FIG. 1 describes a generalized process of the present invention. A continuous film tube (10) is formed using the VFFS machine. In the next step, the longitudinal edges (40) of the film (10) are sealed together to form a vertical seal (35).

The VFFS machine further includes a horizontal sealing section (45). In the horizontal sealing section (45), the film tube (10) with its longitudinal edges already sealed, undergoes transverse heat-sealing. Typically, a pair of sealing jaws (50 & 55) helps form the transverse heat seal. Typically, the sealing jaws (50 & 55) are also associated with a cutting apparatus (not shown) that severs the pouch that has already been made and filled, from the next-to-be filled pouch.

The apparatus of the present invention further comprises a filling station, typically comprising a product (65) balance tank (200) and a supply conduit (60) above horizontal sealing section (45). After making the bottom horizontal seal (70), but before the sealing jaws (50 & 55) are closed, a quantity of product (65) is supplied to the continuous film tube (10) via the supply conduit (60), which fills the continuous film tube (10) upwardly from the transverse seal (70). The product (65) flows from the external balance tank (200) by exiting through its outlet port (210). From the outlet port (210), the product (65) flows through tubing (215). The tubing (215) conveys the product (65) to the supply conduit (60) within the film tube (10). The supply conduit (60), in turn, conveys the product to the continuous film tube (10). The supply conduit (60) can have a nozzle (62) that delivers the product (65) to the continuous film tube (10). From the continuous film tube (10), the product (65) enters the pouch (72) and fills it up.

The continuous film tube (10) is then caused to move downwardly a predetermined distance. This movement in called indexing (71) of the continuous film tube (10). This movement may be under the weight of the material (65) in the continuous film tube (10), or may be caused by pulling or mechanical driving of the continuous film tube (10D). After indexing, the sealing jaws (50 & 55) are activated and close the pouch (72) at its top. The sealing jaws (50 & 55) typically seal and sever the continuous film tube (10).

The balance tank (200) comprises an inlet port (220), an outlet port (210), a lid (225) and a stand-pipe (230). Product passing through the outlet port (210) is drained into the outlet port (210) from the tank (200) through the stand-pipe (230). The stand-pipe is mounted on the inside of the tank (200), but above the outlet port (210).

In one embodiment, the open end (235) of the stand-pipe (230) is at the same height as the inlet port (220) height. In another embodiment, the open end (235) of the stand-pipe (230) is lower in height than the inlet port (220) height. In another embodiment, the open end (235) of the stand-pipe (230) is higher in height than the inlet port (220) height.

Figure 2A:
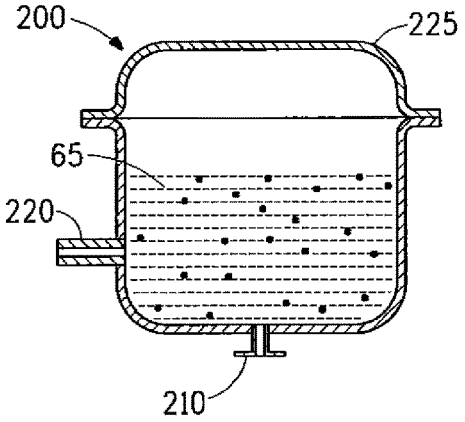
FIG. 2A illustrates a conventional balance tank for supplying flowable material or product to a VFFS machine for pouch-making.
Figure 2B:
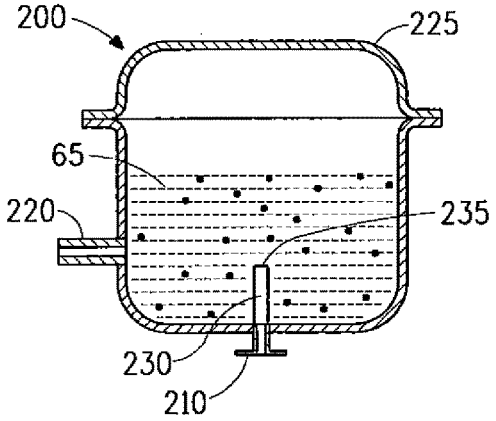
FIG. 2B illustrates a balance tank of the present invention for supplying flowable material or product to a VFFS machine for pouch-making.
Figure 2C:
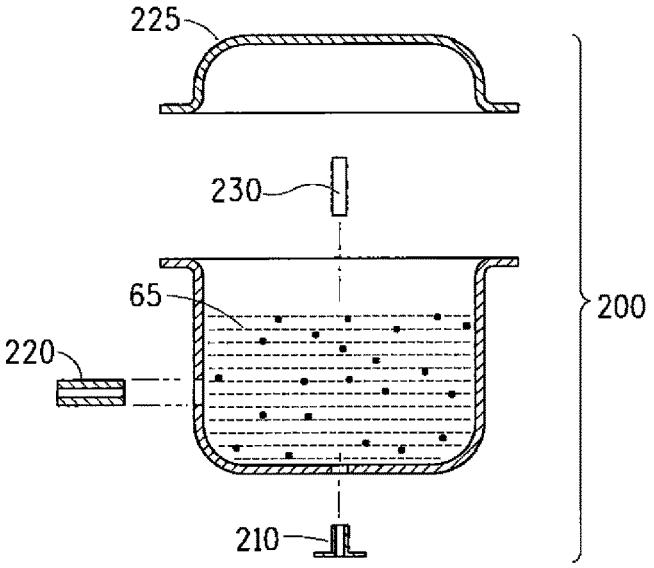
FIG. 2C shows an exploded view of the balance tank in FIG. 2B.

FIG. 2A shows a balance tank (200) in a conventional process, that is, without a stand-pipe, for supplying product (65). FIG. 2B shows one embodiment of the tank (200) of the present invention, wherein a stand-pipe (230) is shown directly above the outlet port (210). FIG. 2C shows an exploded view of the balance tank (200) of FIG. 2B.

Figure 3:
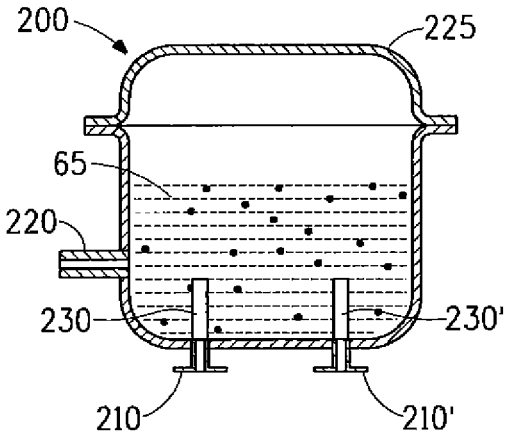
FIG. 3 illustrates a balance tank of the present invention with more than one stand-pipe.

FIG. 3 shows the balance tank (200) for supplying product (65), wherein the balance tank shows more than two stand-pipes (230 and 230') over more than two outlets (210 & 210'). In other embodiments of the invention, the balance tank includes more than one stand-pipe, for example, two, three, four, five, etc. One or multiple stand-pipes could be used to fill only one VFFS machine or multiple VFFS machines.

Figure 4:
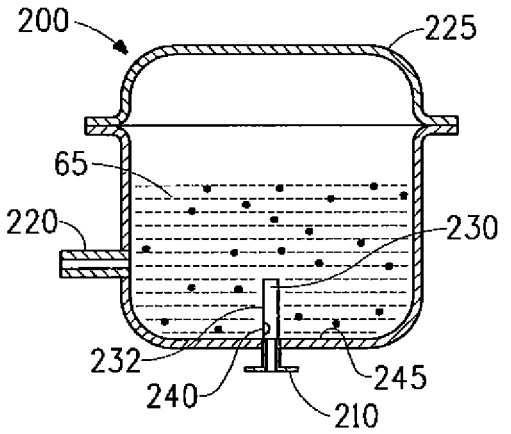
FIG. 4 illustrates a balance tank of the present invention with a drain-hole proximate to the stand-pipe at the tank floor.

FIG. 4 shows the balance tank (200) for supplying product (65), wherein the balance tank shows a stand-pipe (230) installed over the outlet port (210) and inside of the balance tank (200). The stand-pipe (230) shows at least one drain-hole (240) at the bottom of the stand-pipe wall (232), where the stand-pipe meets the floor (245) of the balance tank (200). Stated another way, the hole is on the standpipe, and not the floor of the balance tank. In an alternative embodiment shown in FIG. 5, the balance tank (200) comprises at least one drain-hole (247) at any point on the floor (245), preferably the lowest point on the floor (245) of the balance tank (200).

As will be apparent to a person skilled in the art, forming a pouch of the present invention may involve additional manufacturing steps (whether prior, during, or after the process of the present invention); for example, the pouch may be fitted with a fitment prior to filling (that is, by way of a fitment application press 54, such as is shown in FIG. 1). The pouch may also form part of a larger package; for example, it may be inserted into a cardboard box (that is, according to the "bag-in-box" principle).

While this invention has been described with reference to illustrative embodiments and examples, the description is not intended to be construed in a limiting sense. For example, the process described herein generally relates to VFFS machines. However, the invention is not limited to VFFS machines. It could easily be applied to other machine configurations used for pouch-making. Thus, various modifications of the illustrative embodiments, as well as other embodiments of the invention, will be apparent to persons skilled in the art upon reference to this description. For example, as will be apparent to persons skilled in the art, while a number of parts are described as being present in the singular or as a pair, there could be one, two or more of these components present in the apparatus of the present invention, for example, there could be multiple supply conduits or stand-pipes. Further, the present invention also encompasses a system for performing the process of the present invention. As will be apparent to a person skilled in the art, while the invention has been described in terms of a single apparatus, the various steps of the process could be performed by different apparatuses that form part of a larger system.

EXPERIMENTAL

It is essential to establish precise control over the flow of the product to obtain good fill-accuracy in the pouch. For example, if steady-state flow was assumed, a fill-accuracy with a standard deviation of 1 g for a 3-L water package requires a standard deviation of 0.033% in the flow-rate of water. Thus, if the packaging machine operates at twenty-five pouches per minute, this would equal a standard deviation of 0.417 g on a target water flow-rate of 1250 g/s.

The purpose of the following examples in the first set of experiments was to show the improvement in fill-accuracy that this invention can achieve. The prototype filler Crystalon™ VFFS machine was set up to run 3000-g pouches at the rate of twenty-five pouches per minute. The filler used a balance tank with a constant-flow delivery system. The inner diameter of the balance tank was 20 inches. The experiments were conducted with filling water into pouches.

Comparative Example 1

The balance tank was filled up to 97% of its capacity. The balance tank did not have a stand-pipe installed on its inside.

Generally, pouches were collected with large head-space to test the fill-accuracy of the process (for this example, and all subsequent examples). Fifty contiguous pouches were collected in a single run after the filler had stabilized. The pouches were then weighed and a standard deviation was calculated. The reported fill-accuracy (pouch weight standard deviation) was 5.93 g. Results are summarized in Table 1.

Example 1

In this example, the balance tank was filled up to 97% of its capacity. The tank included a 3-inch long stand-pipe mounted over its outlet port and on its floor. No drain-hole was present either on the stand-pipe, or on the floor of the tank.

Fifty contiguous pouches were collected in a single run after the filler has stabilized. The ouches were then weighed and a standard deviation was calculated. The reported fill-accuracy was 4.04 g. Results are summarized in Table 1.

Example 2

The liquid-food packaging equipment must comply with the sanitary requirement standards. Under these standards (3-A Sanitary Standards), the balance tank must completely self-drain when the outlet(s) is/are opened. However, if a stand-pipe is installed in such a balance tank (as is the case in the present invention), the sanitary requirement may not be fulfilled.

The balance tank was filled up to 85% of its capacity. The balance tank included a ½-inch long stand-pipe mounted over the outlet port of the tank on the floor of the tank. A drain-hole was present on the stand-pipe wall at the floor of the balance tank. The drain-hole was made so that the balance tank can self-drain completely.

Fifty contiguous pouches were collected in a single run after the filler had stabilized. The pouches were then weighed and a standard deviation was calculated. The reported fill-accuracy was 3.18 g. Results are summarized in Table 1.

Example 3

The balance tank was filled up to 97% of its capacity. The balance tank included a 3-inch long stand-pipe mounted over the outlet port of the tank and on the floor of the tank. No drain-hole was present either on the stand-pipe, or on the floor of the balance tank.

Under steady-state operation, standard deviation in fill-accuracy (flow-rate) was calculated to be 0.002649 L/s. Results are summarized in Table 2.

Example 4

The balance tank was filled up to 97% of its capacity. The balance tank included a ½-inch long stand-pipe mounted over the outlet port of the tank on the floor of the tank. No drain-hole was present either on the stand-pipe, or on the floor of the balance tank.

Under steady-state operation, standard deviation in fill-accuracy (flow-rate) was calculated to be 0.002909 L/s. Results are summarized in Table 2.

Example 5

The balance tank was filled up to 97% of its capacity. The balance tank included a ½-inch long stand-pipe mounted over the outlet port of the tank on the floor of the tank. No drain-hole was present either on the stand-pipe, or on the floor of the balance tank.

Under steady-state operation, standard deviation in fill-accuracy (flow-rate) was calculated to be 0.002805 L/s. Results are summarized in Table 2.

Example 6

The balance tank was filled up to 85% of its capacity. The balance tank included a ½-inch long stand-pipe mounted over the outlet port of the tank on the floor of the tank. No drain-hole was present either on the stand-pipe, or on the floor of the balance tank.

TABLE 1

| Example No. | Tank Capacity Percent | Stand-Pipe | Stand-Pipe Length | Drain Hole | Fill-Accuracy (Standard Deviation) | Percent Improvement |
|---|---|---|---|---|---|---|
| Comparative Example | 97 | No | -NA- | No | 5.93 g | -NA- |
| Example 1 | 97 | Yes | 3 inches | No | 4.04 g | 32% |
| Example 2 | 85 | Yes | ½ inch | Yes; at bottom of stand-pipe wall at the intersection of the tank floor | 3.18 g | 46% |

Steady-State Experiments

In a second set of experiments, the prototype filler Crystalon™ VFFS machine was set up to run 3000-g pouches at the rate of twenty-five pouches per minute. The filler used a 20-inch inner diameter balance tank with a constant-flow delivery system. However, the experiments were run without any pouch formation. Stated another way, the flow-rate was maintained at steady-state and the fill-accuracy optimization was extrapolated from the standard deviation of the flow-rates with varying tank parameters. A flowmeter was used to measure the variation in the flow-rate.

Under steady-state operation, standard deviation in fill-accuracy (flow-rate) was calculated to be 0.002471 L/s. Results are summarized in Table 2.

Example 7

The balance tank was filled up to 75% of its capacity. The balance tank included a ½-inch long stand-pipe mounted over the outlet port of the tank on the floor of the tank. No drain-hole was present either on the stand-pipe, or on the floor of the balance tank.

Under steady-state operation, standard deviation in fill-accuracy (flow-rate) was calculated to be 0.002925 L/s. Results are summarized in Table 2.

Example 8

The balance tank was filled up to 85% of its capacity. The balance tank included a ½-inch long stand-pipe mounted over the outlet port of the tank on the floor of the tank. A drain-hole was present on the stand-pipe wall at the floor of the balance tank. The drain-hole was made so that the balance tank can self-drain completely.

Under steady-state operation, standard deviation in fill-accuracy (flow-rate) was calculated to be 0.002486 L/s. Results are summarized in Table 2.

Example 9

The balance tank was filled up to 85% of its capacity. The balance tank included a ½-inch long stand-pipe mounted over the outlet port of the tank on the floor of the tank. A drain-hole was present on the stand-pipe wall at the floor of the balance tank. The drain-hole was made so that the balance tank can self-drain completely. The stand-pipe was centered more on the outlet than in Example 8.

Under steady-state operation, standard deviation in fill-accuracy (flow-rate) was calculated to be 0.002015 L/s. Results are summarized in Table 2.

All results are summarized in Table 2 on the next page. Also in Table 2, the fill-accuracy was calculated as standard deviation of the weight of twenty-five 3-L pouches. We note that the product for all the above examples was water.

TABLE 2

Steady-State Operation

| Example No. | Tank Capacity Percent | Stand-Pipe | Stand-Pipe Length | Drain Hole | Fill-Accuracy (Standard Deviation) × $10^3$ ** |
|---|---|---|---|---|---|
| Example 3 | 97 | Yes | 3 inches | No | 2.649 L/s (6.36 g) |
| Example 4 | 97 | Yes | ½ inch | No | 2.909 L/s (6.98 g) |
| Example 5 | 97 | Yes | ½ inch | No | 2.805 L/s (6.73 g) |
| Example 6 | 85 | Yes | ½ inch | No | 2.471 L/s (5.93 g) |
| Example 7 | 75 | Yes | ½ inch | No | 2.925 L/s (7.02 g) |
| Example 8 | 85 | Yes | ½ inch | Yes; at bottom of stand-pipe wall at the intersection of the tank floor | 2.486 L/s (5.97 g) |
| Example 9 | 85 | Yes | ½ inch | Yes; at bottom of stand-pipe wall at the intersection of the tank floor | 2.015 L/s (4.84 g) |

** Values in brackets are equivalent gram standard deviations. These were computed by taking the flow standard deviations and multiplying them by 1000 to convert from a liter to milliliter, and multiplying again by 2.4 seconds, that is, the time to fill a single pouch. The water density was assumed to be 1 g/ml.

LISTING OF PARTS

FIG. 1
10 continuous film tube
35 vertical sealing section
40 longitudinal edges of the film
45 horizontal sealing section
50 & 55 horizontal sealing jaws
54 fitment application press
60 supply conduit
65 product or flowable material
70 bottom horizontal seal
71 indexing process
72 pouch
200 balance tank
210 outlet port
215 supply tubing
220 inlet port
225 balance tank lid
230 stand-pipe
235 open end of stand pipe FIG. 2A
65 product
200 balance tank
210 outlet port
220 inlet port
225 balance tank lid FIG. 2B
65 product
200 balance tank
210 outlet port
220 inlet port
225 balance tank lid
230 stand-pipe
235 open end of stand-pipe FIG. 2C
65 product
200 balance tank
210 outlet port
220 inlet port
225 balance tank lid
230 stand-pipe FIG. 3
65 product
200 balance tank
210 outlet port
210' second outlet port
220 inlet port
225 balance tank lid
230 stand-pipe
230' second stand-pipe FIG. 4
65 product

Figure 5:
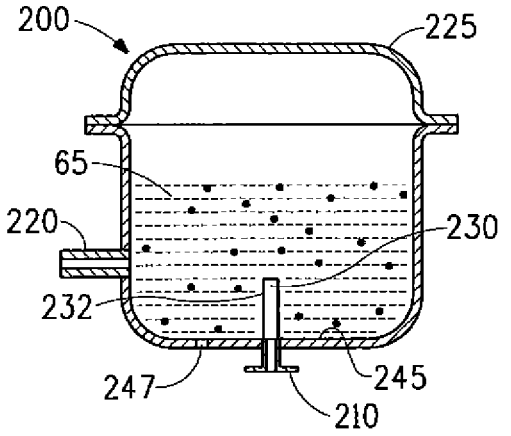
FIG. 5 illustrates a balance tank of the present invention with the a drain-hole not proximate to the stand-pipe, but on the tank floor.

200 balance tank
210 outlet port
220 inlet port
225 balance tank lid
230 stand-pipe
232 stand-pipe outside wall
240 drain-hole
245 tank floor
FIG. 5
65 product
200 balance tank
210 outlet port
220 inlet port
225 balance tank lid
230 stand-pipe
245 tank floor
247 drain-hole

The invention claimed is:

1. A process for forming a pouch with improved fill-accuracy, said process comprising the steps of:

(A) providing a continuous tube of flexible and sealable film;

(B) supplying the continuous tube with a predetermined flow-rate of flowable material fed from an external balance tank; wherein said balance tank comprises an inlet for said flowable material, at least one outlet for said flowable material, and at least one stand-pipe within said balance tank and over said at least one outlet, wherein said stand-pipe is flowably attached to said at least one outlet, such that the inside of said balance tank is at a steady state and localized disturbances are reduced and wherein said balance tank feeds at least one continuous flexible tube and wherein the height of said stand-pipe, measured as a percentage of the level of said flowable material in said balance tank is in the range from about 1% to about 99%.

2. The process as recited in claim 1, wherein the height of the stand-pipe, measured as a percentage of the level of said flowable material in said tank is in the range of from about 3% to about 25%.

3. The process as recited in claim 1, wherein said at least one stand-pipe is substantially centrally located on said at least one outlet.

4. The process as recited on claim 1, wherein said balance tank has a floor, and said balance tank comprises at least one drain-hole on the floor of said balance tank.

5. The process as recited on claim 1, wherein said balance tank comprises at least one drain-hole on said stand-pipe.

6. The process as recited on claim 1, wherein said balance tank comprises at least one drain-hole on said stand-pipe, wherein said drain-hole is at the base of said stand-pipe.

7. The process as recited on claim 1, wherein said balance tank has a floor, and said balance tank comprises at least one drain-hole on said stand-pipe and at least one drain-hole on the floor of said balance tank.

8. The process as recited in claim 1, wherein said balance tank is filled at least 30% of its volume with flowable material.

9. The process of claim 1, wherein said at least one stand pipe comprises a cross-section selected from the group consisting a circular cross-section, a random cross-section, a cross-section that varies in vertical direction, and a cross-section with at least three defined angles, wherein the sides of said cross-section are equilateral.

* * * * *